US012172800B2

(12) United States Patent
Siew

(10) Patent No.: US 12,172,800 B2
(45) Date of Patent: Dec. 24, 2024

(54) GIFT BAG WITH SURPRISE ELEMENTS WHEN OPENING

(71) Applicant: Send A Cake LLC, Bellevue, WA (US)

(72) Inventor: James T. Siew, Bellevue, WA (US)

(73) Assignee: SEND A CAKE LLC, Bellevue, WA (US)

( * ) Notice: Subject to any disclaimer, the term of this patent is extended or adjusted under 35 U.S.C. 154(b) by 53 days.

(21) Appl. No.: 18/218,745

(22) Filed: Jul. 6, 2023

(65) Prior Publication Data

US 2023/0348144 A1 Nov. 2, 2023

Related U.S. Application Data

(63) Continuation-in-part of application No. 29/845,809, filed on Jul. 11, 2022, now Pat. No. Des. 995,313, and
(Continued)

(51) Int. Cl.
*A63H 13/16* (2006.01)
*A63H 37/00* (2006.01)
(Continued)

(52) U.S. Cl.
CPC ..... *B65D 33/004* (2013.01); *B65D 31/04* (2013.01); *B65D 31/10* (2013.01); *B65D 33/16* (2013.01); *B65D 2313/02* (2013.01)

(58) Field of Classification Search
CPC ..... A63H 13/16; A63H 37/00; B65D 31/04; B65D 31/06; B65D 31/10; B65D 33/004; B65D 33/02; B65D 61/00; B65D 73/0078
(Continued)

(56) References Cited

U.S. PATENT DOCUMENTS

D130,591 S 12/1941 Oestierreicher
3,339,721 A * 9/1967 Goldstein ..... B65D 33/02 206/583

(Continued)

OTHER PUBLICATIONS

Butterflyers, "Exploding Flying Butterfly Gift Box from Butterflyers.com—Quick Tips & Instructions", youtube.com, <https://www.youtube.com/watch?v=t9aXGrMgpdk&t=6s> (Aug. 24, 2021).*

(Continued)

*Primary Examiner* — Thanh K Truong
*Assistant Examiner* — Patrick B Fry
(74) *Attorney, Agent, or Firm* — Davis Wright Tremaine LLP

(57) ABSTRACT

A bag comprising a first flap assembly having a first and second flap, at least one coupler comprising a pair of corresponding coupler sides disposed respectively at the first and second flaps of the first flap assembly, and a first and second pull respectively extending from the first and second flaps of the first flap assembly. The bag further comprises a second flap assembly comprising a third and fourth flap, an internal compartment disposed within the first and second flap assemblies and that defines a compartment cavity and opposing external faces, first and second slots defined by the external faces of the internal compartment and the third and fourth flaps of the second flap assembly, and third and fourth slots defined by the first and second flaps of the first flap assembly and the third and fourth flaps of the second flap assembly.

20 Claims, 10 Drawing Sheets

Related U.S. Application Data a continuation-in-part of application No. 29/832,633, filed on Mar. 29, 2022, now abandoned.

(60) Provisional application No. 63/388,050, filed on Jul. 11, 2022.

(51) Int. Cl.

| | |
|---|---|
| ***B65D 30/08*** | (2006.01) |
| ***B65D 30/20*** | (2006.01) |
| ***B65D 33/00*** | (2006.01) |
| ***B65D 33/02*** | (2006.01) |
| ***B65D 33/16*** | (2006.01) |
| ***B65D 61/00*** | (2006.01) |
| ***B65D 73/00*** | (2006.01) |

(58) Field of Classification Search

USPC ..... 53/158; 229/117.27; 383/18, 119; 446/310, 475; 472/52, 54, 55

See application file for complete search history.

(56) References Cited

U.S. PATENT DOCUMENTS

| | | | | |
|---|---|---|---|---|
| 3,926,364 | A * | 12/1975 | Janhohen | B65D 33/02 383/92 |
| 5,120,263 | A * | 6/1992 | Lerfino | A63H 13/16 273/459 |
| D369,473 | S | 5/1996 | Gluck | |
| D406,468 | S | 3/1999 | Byers | |
| 5,933,989 | A * | 8/1999 | Volkert | G09F 1/06 446/148 |
| D472,139 | S | 3/2003 | Rizzuto, Jr. | |
| D557,904 | S | 12/2007 | Engber | |
| D641,177 | S | 7/2011 | Chamberlain | |
| D730,745 | S | 6/2015 | Cowan-Hughes et al. | |
| D784,824 | S | 4/2017 | Ross | |
| D796,342 | S | 9/2017 | Ross | |
| D802,390 | S | 11/2017 | Walbroel | |
| 10,035,634 | B2 * | 7/2018 | Murphy | B65D 33/02 |
| D842,122 | S | 3/2019 | Song | |
| D873,673 | S | 1/2020 | Yu et al. | |
| D873,674 | S | 1/2020 | Yu et al. | |
| D876,239 | S | 2/2020 | Yu et al. | |
| D901,190 | S | 11/2020 | Horton | |
| D953,876 | S | 6/2022 | Hishmeh | |
| D964,858 | S | 9/2022 | Tan | |
| D984,901 | S | 5/2023 | Liu | |
| D995,313 | S | 8/2023 | Siew | |
| 2006/0113215 | A1 * | 6/2006 | Clements | B65D 5/18 206/461 |
| 2013/0341217 | A1 * | 12/2013 | Chasan | B65D 5/503 206/232 |

OTHER PUBLICATIONS

Send a Cake, LLC, "Innovative Cake Gifts—Birthday Cake Gift Delivery," retrieved from https://sendacake.com/ on Feb. 27, 2024, 7 pages.

* cited by examiner

GIFT BAG WITH SURPRISE ELEMENTS WHEN OPENING

CROSS-REFERENCE TO RELATED APPLICATIONS

This application is a non-provisional of and claims the benefit of U.S. Provisional Application No. 63/388,050, filed Jul. 11, 2022, entitled "GIFT BAG WITH SURPRISE ELEMENTS WHEN OPENING,". This application is hereby incorporated herein by reference in its entirety and for all purposes.

This application is related to and is a continuation-in-part of U.S. Design patent application Ser. No. 29/832,633, filed Mar. 29, 2022, entitled "GIFT BAG,". This application is hereby incorporated herein by reference in its entirety and for all purposes.

This application is also related to and is a continuation-in-part of U.S. Design patent application Ser. No. 29/845,809, filed Jul. 11, 2022, entitled "GIFT BAG,". This application is hereby incorporated herein by reference in its entirety and for all purposes.

Figure 1:
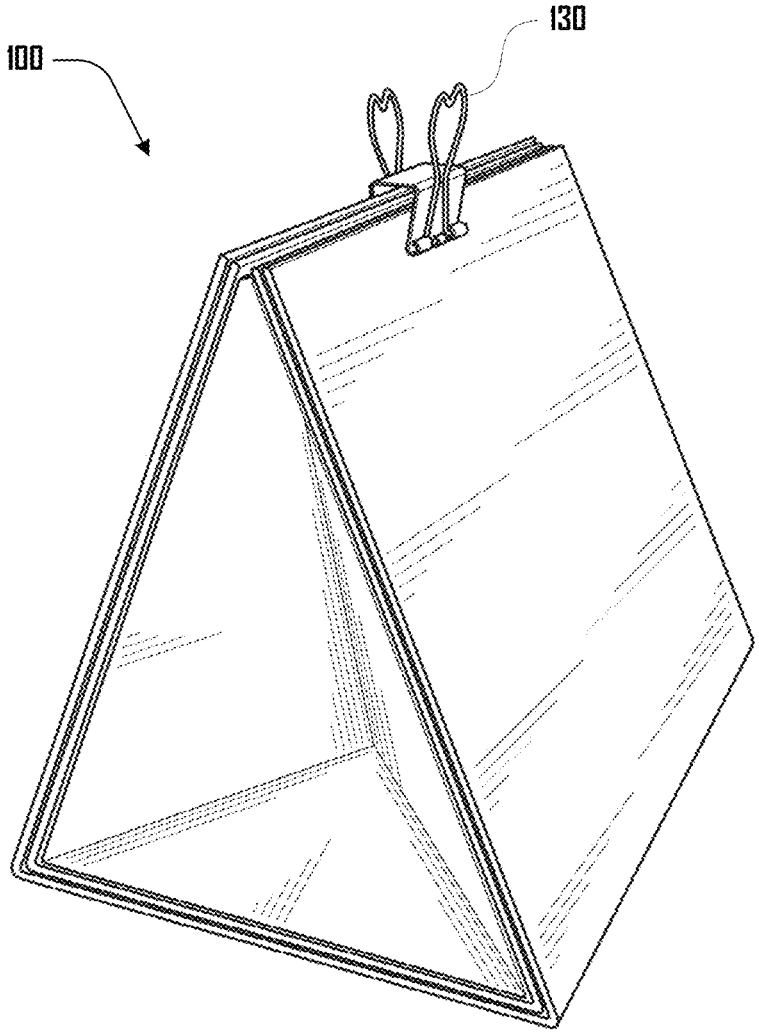
FIG. 1 is a perspective view an embodiment of a gift bag in a closed configuration.
Figure 2:
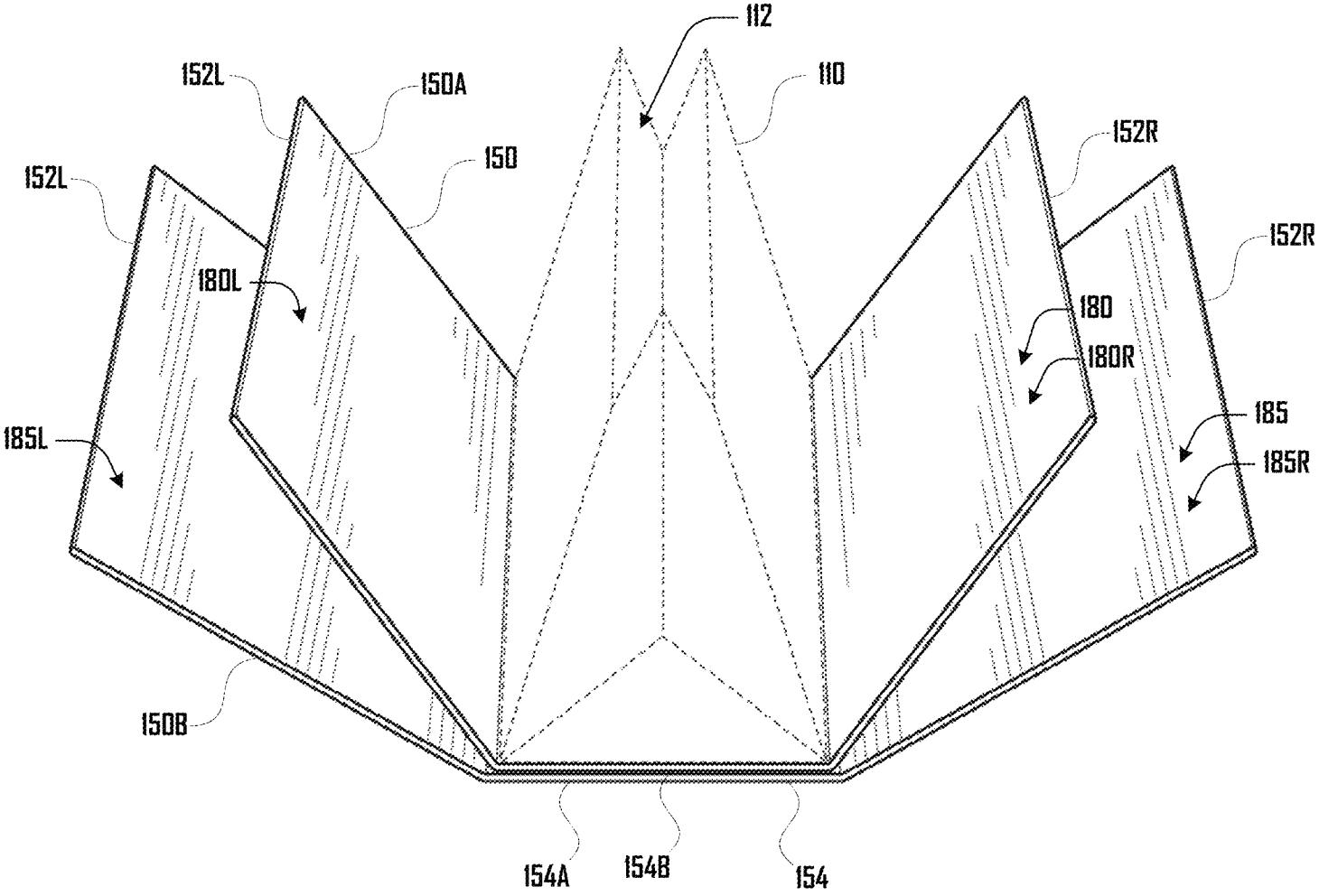
FIG. 2 is a perspective side view of the gift bag of FIG. 1 in an open configuration.

It should be noted that the figures are not drawn to scale and that elements of similar structures or functions are generally represented by like reference numerals for illustrative purposes throughout the figures. It also should be noted that the figures are only intended to facilitate the description of the preferred embodiments. The figures do not illustrate every aspect of the described embodiments and do not limit the scope of the present disclosure.

DETAILED DESCRIPTION OF THE PREFERRED EMBODIMENTS

The following disclosure relates to a gift bag with surprise elements that appear when the bag is opened. For example, FIGS. 1-9 illustrate one example embodiment of a gift bag

100 that comprises an internal bag 110 that defines a bag cavity 112, which is surrounded by a pair of nested flap assemblies 150A, 150B that each comprise left and right flaps 152L, 152R which are movably coupled to a base 154. Faces of the internal bag 110 and/or flaps 152 define a plurality of slots 180, 185. Specifically, in this example, the internal bag 110 and flaps 152L, 152R of the second flap assembly 150B define a first pair of slots 180L, 180R. The flaps 152L, 152R of the first flap assembly 150A and the flaps 152L, 152R of the second flap assembly 150B define a second pair of slots 185L, 185R.

Figure 3:
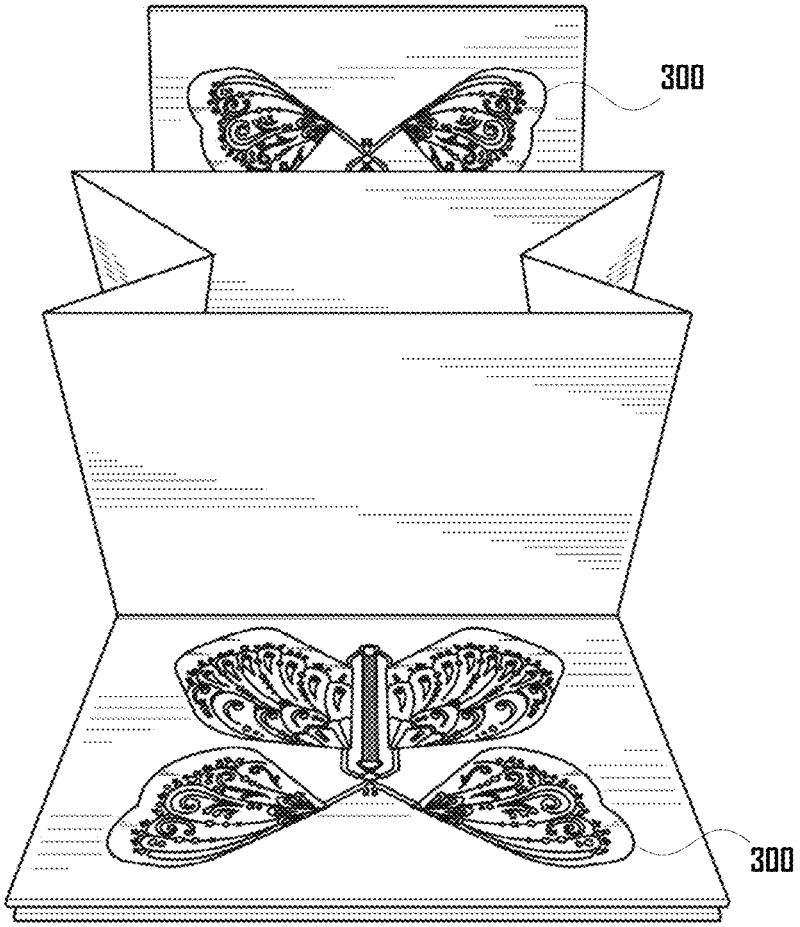
FIG. 3 is a perspective front view of the gift bag of FIGS. 1 and 2 showing the gift bag loaded with actuating butterflies.
Figure 4:
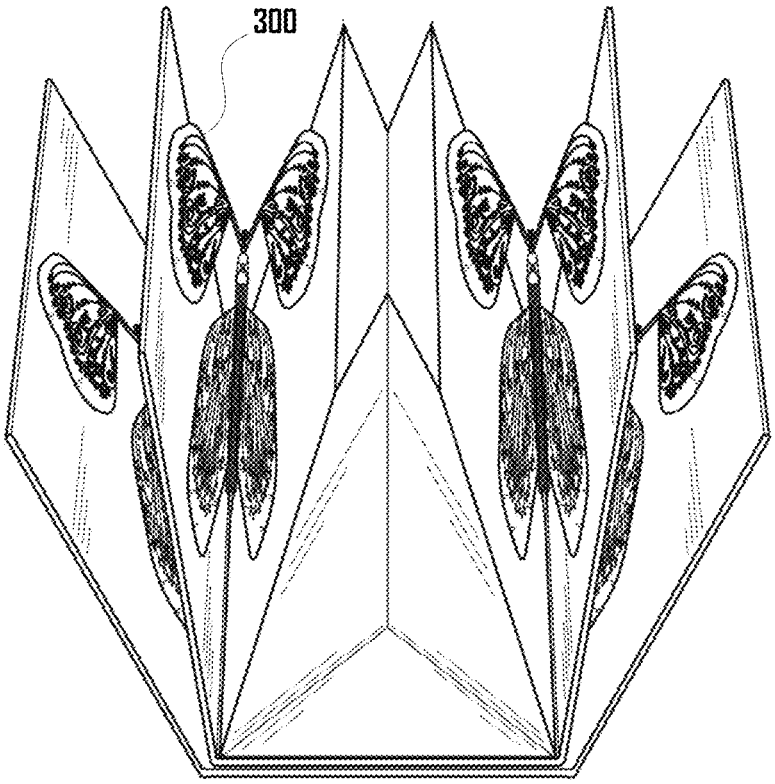
FIG. 4 is a perspective front view of the gift bag of FIGS. 1, 2 and 3 while opening and having a plurality of actuating butterflies begin to fly out of slots in the gift bag.
Figure 5:
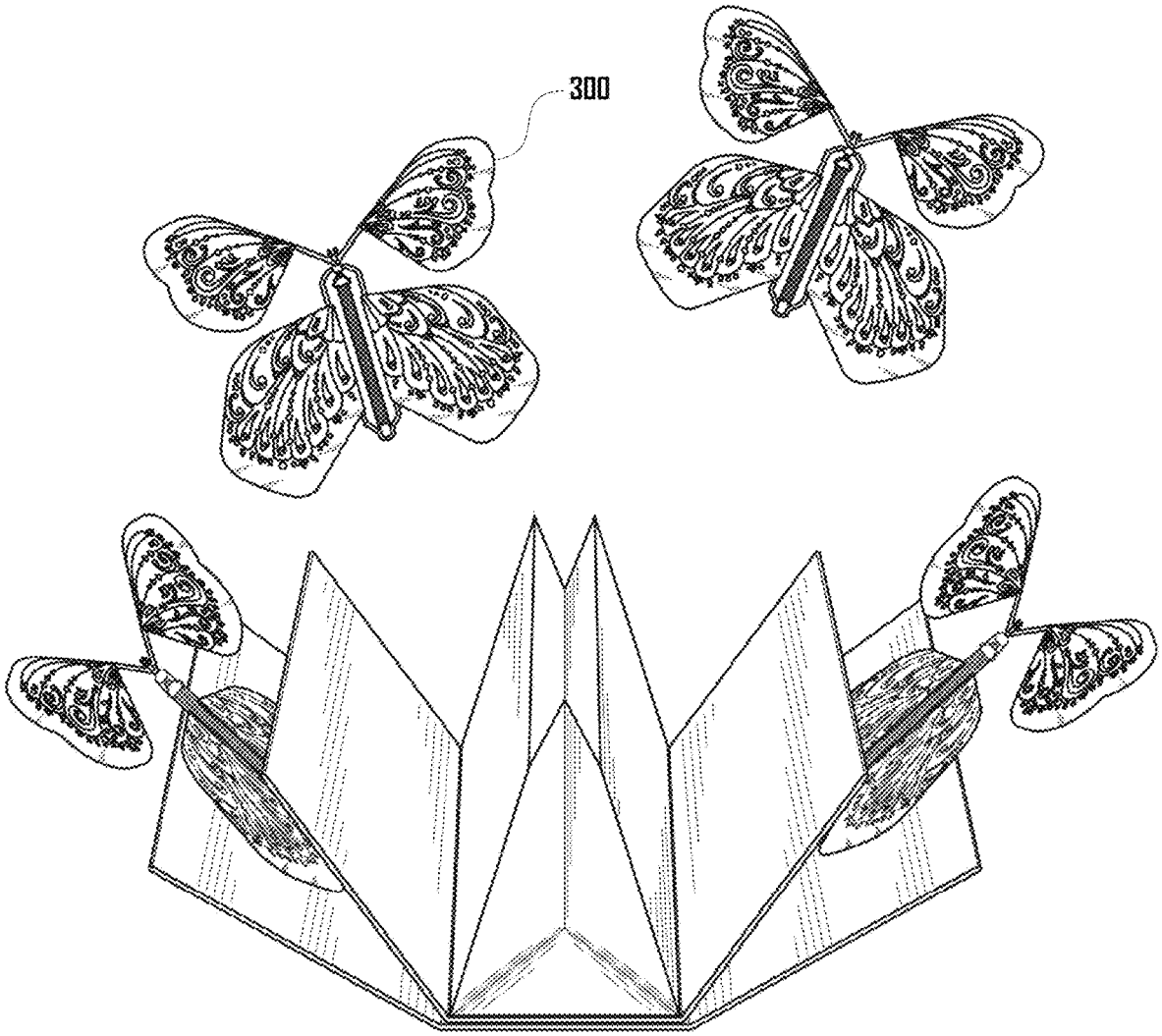
FIG. 5 is a perspective front view of the gift bag of FIGS. 1, 2, 3 and 4 with actuating butterflies flying out of the slots in the gift bag.
Figure 7:
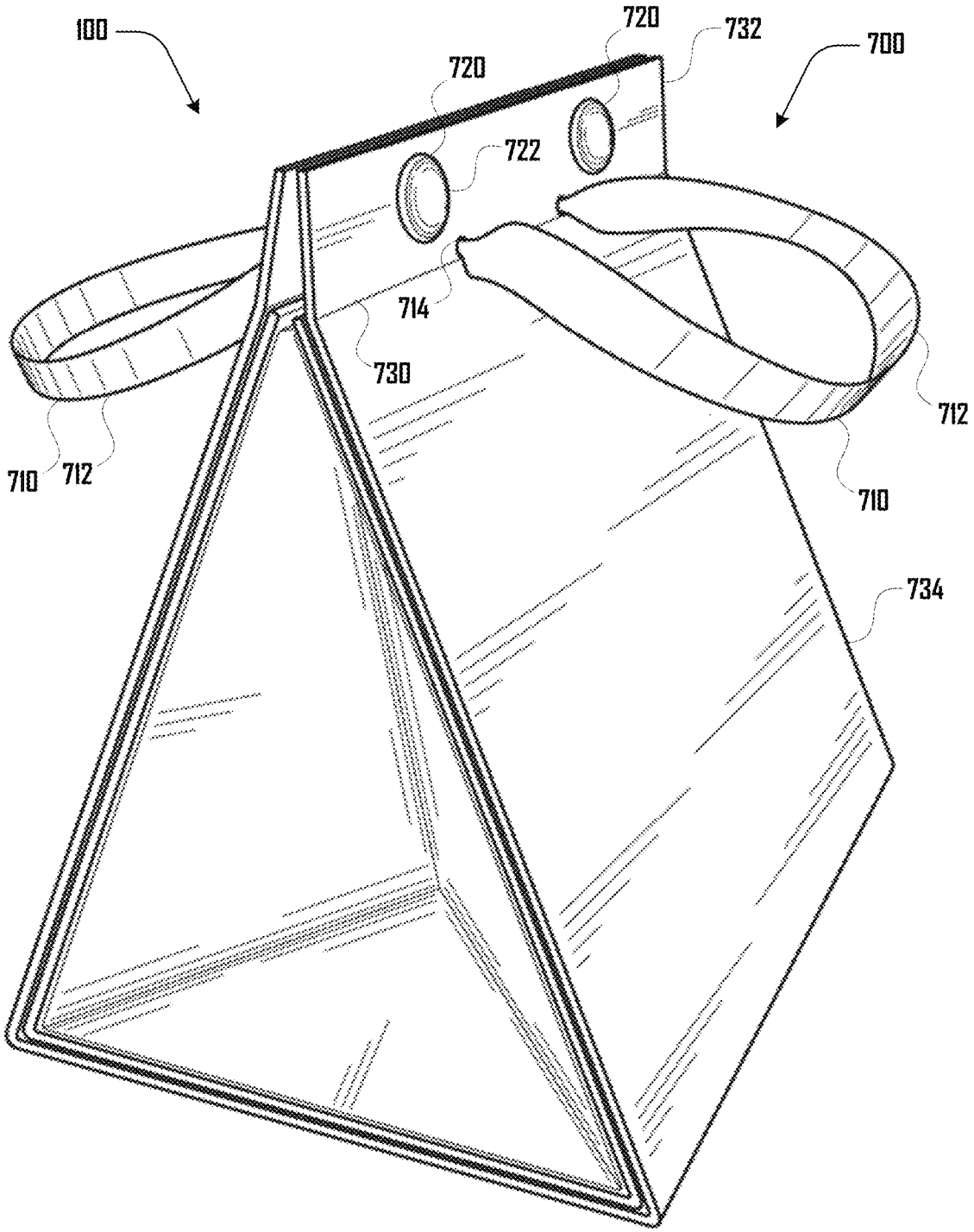
FIG. 7 is a perspective view another embodiment of a gift bag in a closed configuration.

As shown in the examples of FIGS. 3 and 4, actuating butterflies 300 can be disposed within the slots 180, 185 and can be configured to pop out of the slots 180, 185 when the gift bag 100 is opened as shown in FIG. 5. For example, the gift bag 100 can be configured in a packed configuration as shown in FIGS. 1 and 7, with the flaps 152 of the flap assemblies 150 folded upward against side faces of the internal bag 110 with tops of the flaps 152 and top of the internal bag 110 being coupled together via a coupler such as a clip 130 that holds these elements together via a pair of corresponding coupler sides of the clip 130. Actuating butterflies 300 can be disposed within the slots 180, 185 in the packed configuration of FIGS. 1 and 7 with the actuating butterflies 300 being held in a loaded configuration by the actuating butterflies 300 being sandwiched between respective flaps 152 or between a flap 152 and an external face of the internal bag 110. In various embodiments, the actuating butterflies 300 can be hidden from view of a user in the packed configuration of FIGS. 1 and 7 such that the actuating butterflies 300 can be a surprise when a user opens the gift bag 100.

For example, to open the gift bag 100, the user can unlock the clip 130 (see FIG. 1), which can allow the flaps 152 to rotate outward away from the internal bag 110, which can allow the slots 180, 185 to open as shown in FIG. 4, which can allow the loaded actuating butterflies 300 to actuate and pop or fly out of the slots 180, 185 as shown in the example of FIG. 5. Such popping out or flying out of the actuating butterflies 300 can occur automatically without user interaction aside from the user releasing the clip, releasing a hold on the flaps 152, or the like.

In another example, an opening assembly 700 can be used to open the gift bag 100. For example, the user can pull on a pair of pulls 710 (see FIGS. 7-9) that extend through the flaps 152 of the first flap assembly 150A, which can cause a pair of coupled couplers 720 to become uncoupled and can allow for the flaps 152 of the first flap assembly 150A to be pulled outward. In various embodiments, the coupling of the couplers 720 can allow for a sudden release once sufficient force is applied by pulling the pulls 710, which can be desirable for generating a rapid opening of the flaps 152 that can provide for a desirable release of the butterflies 300.

In various embodiments, the couplers 720 can extend through the flaps 152 of the first flap assembly 150A with complementary first and second coupler sides 722, 724 being releasably coupled together over the flaps 152 of the second flap assembly 150B and over the top of the internal bag 110. As shown in the example embodiment of FIGS. 7-9, the flaps 152 of the first flap assembly 150A can be longer than the flaps 152 of the second flap assembly 150B Additionally, in various embodiments, the pulls 710 can extend through the flaps 152 via holes 714 defined by the first flap assembly 150A, with the pulls 710 in some embodiments being a loop (e.g., a ribbon, string, rope, line, or the like) having an external portion 712 and an internal portion 716 (e.g., a tie, knot, tab, stop, or the like). In various examples, in a closed configuration, the pulls 710 can extend through the flaps 152 of the first flap assembly 150A with the internal portions 716 being disposed over the flaps 152 of the second flap assembly 150B and over the top of the internal bag 110 and below the couplers 720.

Figure 9:
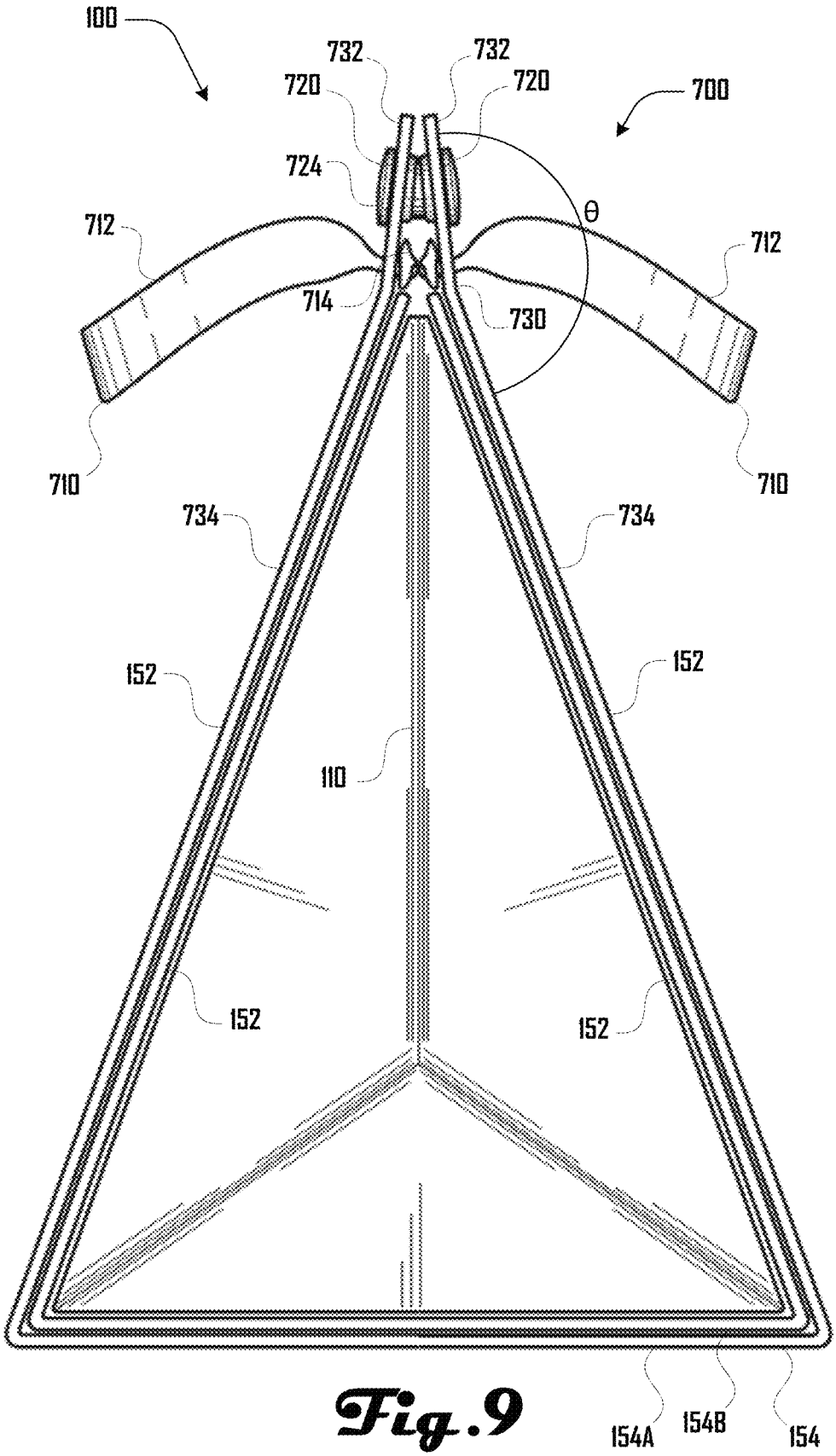
FIG. 9 is a side view of the gift bag of FIGS. 7 and 8 in a closed configuration.
Figure 10A:
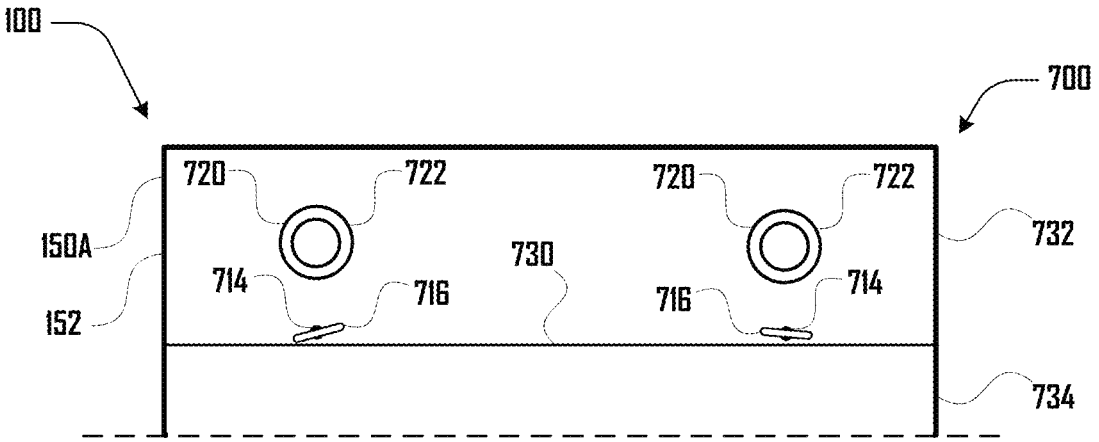
FIG. 10*a* is a side view of an opening assembly of one embodiment of a gift bag that comprises corresponding snaps.
Figure 10B:
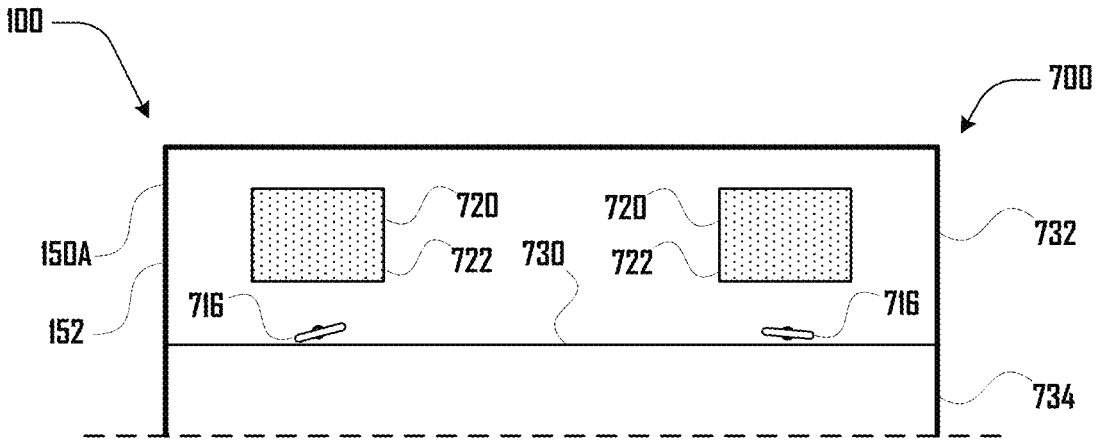
FIG. 10*b* is a side view of an opening assembly of another embodiment of a gift bag that comprises corresponding portions of hook-and-loop tape.

Further embodiments can comprise various suitable elements that allow the flaps 152 of the first flap assembly 150A to be pulled, so the example of pulls 710 should not be construed as being limiting. For example, FIG. 9 illustrates an embodiment where the pulls 710 comprise a loop of ribbon that extends through the holes 714 defined by the first flap assembly 150A with the internal portions 716 of the pull 710 comprising ends of the ribbon tied together in a knot. However, in further embodiments one or both of the external portion 712 and internal portion 716 of the pulls 710 may not include a coupled loop or element and may be separate. For example, FIGS. 10*a* and 10*b* illustrate embodiments where the internal portions 716 of the pulls 710 comprise a tab or stop that holds the pull 710 and couples the pull 710 to the first flap assembly 150A by preventing the pull 710 from being pulled through the holes 714. Note that while FIGS. 10*a* and 10*b* only show one side 722 of a pair of couplers 720, the configuration of opposing couplers 724 should be clear based on the present disclosure.

For example, while FIG. 10*b* illustrates only hook or loop portions of a coupler 720, it should be clear that opposing hook or loop portions can be correspondingly present on an opposing flap 152 of the first flap assembly 150A. Also, FIG. 10*b* illustrates an example having two separate portions 722 of a hook-and-loop coupler 720, which can be desirable for providing a preferred opening characteristic for the gift bag 100. For example, when the holding force of the pair of hook-and-loop couplers 720 are overcome, the gift bag 100 can "pop" open quickly and dynamically to facilitate a desirable release of actuating butterflies 300 or the like. Such a configuration of a pair of hook-and-loop couplers 720 in some embodiments can be desirable over an alternative configuration with a single strip of hook-and-loop tape coupler 720. Accordingly, the configuration such hook-and-loop couplers 720 is not a simple obvious design choice in various embodiments and can provide desirable and unexpected results in the context of various configurations of the novel design of a gift bag 100 disclosed herein in various example embodiments. The dimensions and/or surface area of such hook-and-loop couplers 720 can be sized based on a desired pull force to de-couple the couplers 720 and to provide a desired dynamic opening response for the gift bag 100 and/or based on a tension of the gift bag 100 in a loaded configuration. For example, the actuating butterflies 300 can be loaded as discussed herein and generate a force on the flaps 152 such that the flaps 152 would be forced outward without holding force of the couplers 720. Accordingly, the couplers 720 can be configured to have a holding force that is greater than a force generated by the gift bag 100 or elements thereof (e.g., natural bias of a living hinge between the flaps 152 and base 154, a biasing element such as a coil or leaf spring, biasing of one or more actuating butterflies 300, or the like) and less than or equal to a desired pull-force that allows a human user to easily open the gift bag 100.

Additionally, in some embodiments, pulls 710 can be absent or present in any suitable plurality. For example, while various embodiments shown herein include a full or partial loop (e.g., loop of ribbon), in some embodiments there can be two or more separate pulls (e.g., a pair of lengths of ribbon that extend through holes 714 of the first flap assembly 150A without being coupled at the internal portions 716). Some embodiments can include a single pull 710, e.g., a knob, handle, rope with knot, single loop of ribbon through a single hole 714, and the like. Also, while various embodiments include one or more pulls 710 comprising a flexible element such as a ribbon, line, rope, twine, or the like, further embodiments can include one or more rigid pulls 710, including a rigid handle, knob, or the like. Also, while various embodiments include both an external portion 712 and internal portion 716 of the one or more pulls 710, in further embodiments, an internal portion 716 can be absent. For example, a pull 710 can be coupled to an external face of the first flap assembly 150A, can extend within and be coupled within the first flap assembly 150A, or the like.

In various embodiments, couplers 720 can comprise pairs of corresponding or complementary coupler sides 722, 724 such as mating snaps (e.g., FIGS. 8, 9 and 10*a*), complementary hook and loop tape (e.g., FIG. 10*b*), magnets, or the like. In some embodiments, couplers can extend through the first flap assembly 150A or only be disposed on internal portions of flaps 152 of the first flap assembly 150A (e.g., hook-and-loop couplers 720 such as shown in FIG. 10*b*). Also, in some embodiments, one or more couplers 720 can comprise various suitable materials such as a gum, polymer, wax, glue, an adhesive, epoxy, a welded material, double-sided tape, or the like. In some embodiments, the couplers 720 can be configured to be multi-use or single use. For example, in some embodiments couplers 720 can be configured to be coupled together, released, coupled together again, released again, etc. (e.g., snaps or hook-and-loop tape such as shown in FIGS. 10*a* and 10*b*); however, in further embodiments, couplers can be configured for single use or for very limited multiple uses. For example, flaps 152 of the first flap assembly 150A can be coupled together with glue, and when pulled apart, the bonding of the flaps 152 via the glue can be broken and inoperable to be re-attached. Also, in further embodiments, there can be any suitable number of couplers 720 (e.g., 1, 2, 3, 4, 5, 10, 25, 50) or couplers 720 can be absent. In various embodiments, couplers are specifically absent from the flaps 152 of the second flap assembly 150B.

Figure 8:
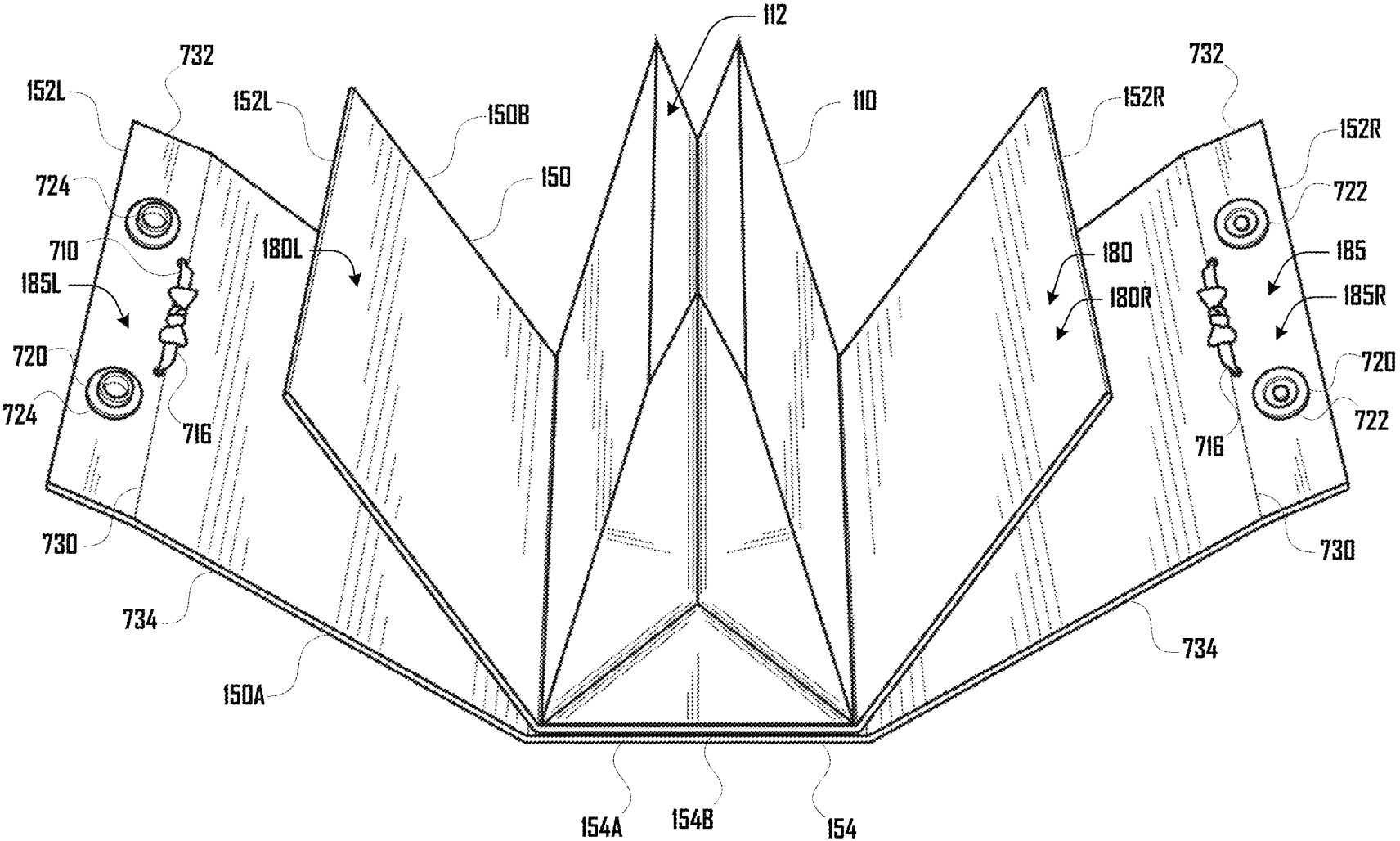
FIG. 8 is a perspective side view of the gift bag of FIG. 7 in an open configuration.

As shown for example in FIGS. 7-9, in some embodiments the flaps 152 of the second flap assembly 150B can be shorter than the flaps 152 of the first flap assembly 150A, which can allow for the couplers 720 and internal portions 716 of the pulls 710 to be disposed over the flaps 152 of the second flap assembly 150B and the internal bag 110. Additionally, as shown in FIGS. 7-9, 10*a* and 10*b*, the flaps 152 of the first flap assembly 150A can comprise a hinge 730 that allows the flaps 152 of the first flap assembly 150A to bend and define upper and lower portions 732, 734 of the flaps 152 of the first flap assembly 150A.

In various embodiments, the hinges 730 can comprise various suitable elements or structures, including a crease, perforation, holes, dent, depression, thinner portion, or the like, in the flaps 152, or in some examples, the first flap assembly 150A or can comprise a physical structure such as a hinge with leaves, knuckles and a pin; a living hinge of a different material than the rest of the flaps 152, and the like. The hinge 730 can comprise a linear structure that extends a portion or the full length of the flaps 152.

In various examples, the hinges 730 can be disposed in a common plane that is coincident with or above the terminal ends of the flaps 152 of the second flap assembly 150B. In various examples, the hinges 730 can be disposed in a common plane that is coincident with or above the terminal ends of the internal bag 110.

In various embodiments the hinges 730 can be configured to allow the top and bottom portions 732, 734 to assume a concave configuration on the external faces of the flaps 152 of the first flap assembly 150A when the couplers 720 are coupled together such as shown in FIG. 9. The top and bottom portions 732, 734 can be disposed at various suitable angles when the couplers 720 are coupled, such as 150°, 152°, 154°, 156°, 158°, 160°, 162°, 164°, 166°, 168°, 170°, 172°, 174°, 176°, or the like, or a range between such example values. In some examples, the top and bottom portions 732, 734 can assume a substantially flat configuration when the couplers 720 are not coupled such as 180°, 179°, 178°, 177°, or the like, or a range between such example values.

Such a configuration of the flaps 152 of the first flap assembly 150A can be desirable to allow the bottom portions 734 of the flaps 152 to generally, substantially or fully lay against or engage the external faces of the flaps 152 of the second flap assembly 150B such as shown in FIG. 9 while also allowing the top portions 732 of the flaps 152 to assume a configuration parallel to each other or at a small angle to each other such as 2°, 4°, 6°, 8°, 10°, 12°, 14°, 16°, 18°, 20°, or the like, or a range between such example values, when the couplers 720 are coupled. Such a configuration can be desirable for providing a preferred shape for the gift bag 100 and also providing for desirable coupling and de-coupling characteristics of the couplers 720 as discussed herein.

In various embodiments, such as shown in FIGS. 10*a* and 10*b*, the holes 714 can be disposed below a respective coupler 720 on the top portion 732 of the flap 152 and above the hinge 730. In various embodiments, a common central axis of an adjacent hole 714 and coupler 720 can be parallel to a second pair of an adjacent hole 714 and coupler 720. Aligning the holes 714, and therefore the pull force locations of the pulls 710, can be desirable by locating such a pull force in a location where de-coupling the couplers is easier such as based on pulling apart of the coupler sides 722, 724 corresponding with the angle between top portions 732 to facilitate easier opening. Accordingly, location of the holes 714 above the hinge 730 and/or in alignment with a central axis of the couplers 720 is not a simple obvious design choice in various embodiments and can provide desirable and unexpected results in the context of various configurations of the novel design of a gift bag 100 disclosed herein in various example embodiments. Also, while the hook-and-loop couplers 720 of FIG. 10*b* are shown having a rectangular shape, further embodiments can include any suitable shape, including oval, circle, triangle, or the like.

Also, in various embodiments, the flaps 152 can extend from a base 154 at various suitable angles. For example, in a closed or loaded configuration such as shown in FIGS. 1, 7 and 9 in one preferred embodiment the flap assemblies 150 can have a base 154 with opposing flaps 152 extend from the base 154 at an angle of 70°. In some embodiments, flaps 152 can extend from a base 154 at an angle of 60°, 61°, 62°, 63°, 64°, 65°, 66°, 67°, 68°, 69°, 70°, 71°, 72°, 73°, 74°, 75°, 76°, 77°, 78°, 79°, 80°, or the like or a range between such example values. Also, such a configuration of the flaps 152 extending from the base 154 can be designed for optimal balance between maximizing the size of the internal bag 110 and an angle that generates desirable ejection of actuating butterflies 300. For example, in some embodiments, having the flaps 152 extending from the base 154 at too small of an angle can make it such that the flaps 152 do not open quickly enough or have suitable outward bias such that the actuating butterflies 300 are not able to escape or do not escape with a desirable effect. Accordingly, the angle between the base 154 and the flaps 152 is not a simple design choice in various embodiments and must be specifically configured for operability and desirable effect of the actuating butterflies 300 or other elements being ejected from the gift bag 100.

In various embodiments, the flaps 152 can be biased to automatically move outward away from the internal bag 110 when released by the user, which can be based on a natural bias of a living hinge between the flaps 152 and base 154, a biasing element such as a coil or leaf spring, biasing of one or more actuating butterflies 300, or the like.

Figure 6:
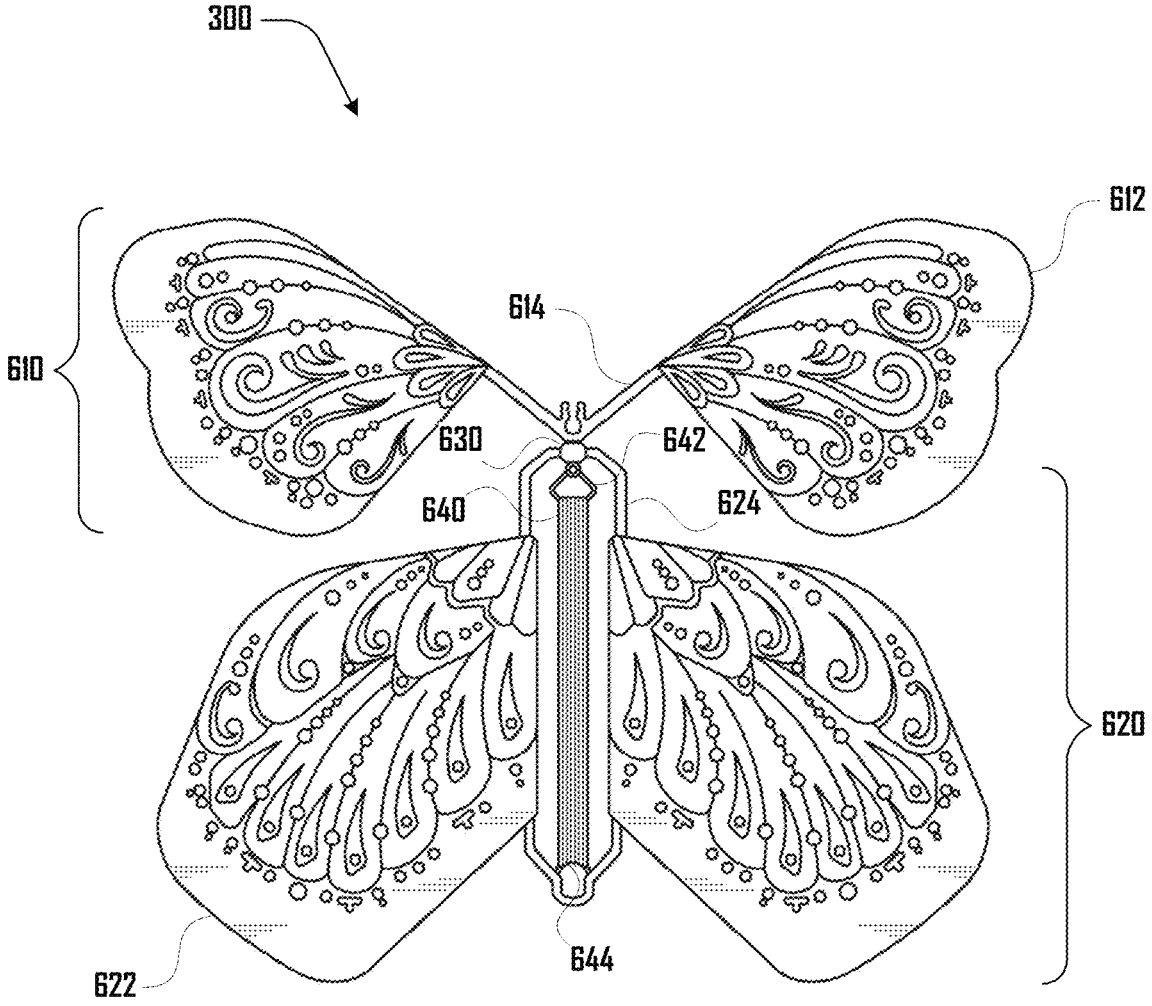
FIG. 6 is an example embodiment of an actuating butterfly.

Turning to FIG. 6, an example of an actuating butterfly 300 in an unloaded configuration is shown where the actuating butterfly 300 comprises a top portion 610 and a bottom portion 620, which are rotatably coupled via an axle 630 that allows the portions 610, 620 to rotate relative to each other about a central axis. The actuating butterfly 300 further comprises an actuating band 640 (e.g., a rubber band) that is coupled to the top portion 610 via a first coupler 642 and coupled to the second portion 620 via a second coupler 644 (e.g., hooks, loops, or the like). In some embodiments, the couplers 642, 644 can be made of a metal material for additional strength.

In various embodiments, the actuating band 640 can allow the actuating butterfly 300 to be loaded for actuation by rotating the top and bottom portions 610, 620 in opposite directions to introduce a twist into the actuating band 640, which can store a rotation force in the actuating band 640 and generate a loaded configuration for the actuating butterfly 300. To pack the gift bag 100, one or more loaded actuating butterflies 300 can be introduced into one or more of the slots 180, 185 and the slots 180, 185 can be closed such that the rotation force in the actuating band 640 is held by the top and bottom portions 610, 620 being held in place relative to each other in a planar configuration. Accordingly, when the slots 180, 185 are opened as discussed herein, the top and bottom portions 610, 620 can be free to rotate relative to each other and the loaded actuating band 640 can cause rotation of the top and bottom portions 610, 620, which can cause lift for the actuating butterfly 300, which can cause the actuating butterfly 300 to pop or fly out of the slots 180, 185 and fly about above or around the gift bag 100. In some embodiments, a frame of the butterfly 300 can be thinned out or minimized to use less material and to reduce the weight for better flight.

In various embodiments the top portion 610 of an actuating butterfly 300 can comprise a pair of top wings 612 held by a top frame 614 comprising a pair of arms that extend from the axle 630. The bottom portion 620 can comprise a pair of bottom wings 622 held by a bottom frame 624 that surrounds the actuating band 640. In various embodiments, the top and bottom wings 612, 622 can be made of various suitable materials such as paper, plastic, foil, cardboard, or the like. In various embodiments, the top and bottom frame 614, 624 can be made of various suitable materials such as plastic, metal, wood, or the like.

In various embodiments, the gift bag 100 and portions thereof can be made of any suitable materials such as paper, plastic, metal, or the like. Additionally, while the example of FIGS. 1-9 illustrates an embodiment having four total slots 180L, 180R, 185L, 185R with two slots 180, 185 on each side of the internal bag 110, further embodiments can include any suitable number of total slots (e.g., 1, 2, 3, 4, 5, 6, 7, 8, 9, 10, 12, 14, 16, 18, 20, and the like) with any suitable number of slots on a given side (e.g., 0, 1, 2, 3, 4, 5, 6, 7, 8, 9, 10, 11, 12, and the like). In some embodiments, there may be the same or a different number of slots on both sides of the internal bag 110.

Also, while various embodiments can comprise rectangular planar flaps 152 and/or faces of an internal bag 110, further embodiments can include flaps and/or faces of an internal bag 110 with various suitable regular or irregular shapes, which may or may not be planar. For example, in some embodiments, the flaps 152 can be rounded, oval, scalloped, or the like. In another example, in some embodiments, the flaps 152 can be curved or rounded (e.g., like the petals of a flower).

Additionally, while the examples of FIGS. 1-9 illustrate an example of a gift bag 100 with a rectangular base 154 having four total slots 180L, 180R, 185L, 185R with two slots 180, 185 on each opposing side of the internal bag 110, further embodiments can include slots and/or flaps on any suitable number of sides of an internal bag 110 (e.g., 1, 2, 3, 4, 5, 6, 7, 8, 9, 10, 11, 12, and the like). In various embodiments, a base 154 can be various suitable shapes to allow for flaps on various suitable sides (e.g., triangular, rectangular, pentagonal, hexagonal, heptagonal, octagonal, nonagonal, decagonal, dodecagonal, or the like).

Also, the example of the actuating butterfly 300 herein should not be construed as being limiting and various suitable actuating elements configured to pop or fly out of slots 180, 185 an be used in addition to or as an alternative to the actuating butterfly 300 discussed herein and/or actuating butterflies 300 of any suitable configuration can be used in further embodiments. For example, further embodiments can include actuating birds, frogs, snakes, grasshoppers, confetti, streamers, or the like. Such elements can be actuated or loaded in various suitable ways and with various suitable elements such as a band, coil, spring, or the like.

Also, while various embodiments can include mechanically actuating elements, further embodiments can include electronic or chemical actuation of a switch, pressure plate, or the like, caused by opening and/or closing of slots. Such mechanical, electronic or chemical actuation can include triggering of a physical movement, ejection of one or more elements (e.g., butterflies or confetti), triggering of an audio output, triggering of a haptic output (e.g., vibration), triggering of a release of a substance (e.g., gas, smoke, fog, liquid, foam, or the like), a small explosion for sound or ejection purposes, or the like.

Also, while various embodiments can include a clip 130 (e.g., a binder clip) or snap, or coupler 720 to hold the gift bag 100 closed, further embodiments can include various suitable elements to hold the gift bag 100, which may or may not be separable or integral to portions of the gift bag 100. For example, in some embodiments the gift bag 100 can be held closed with a clasp, friction fit, adhesive, wax, glue, weld, or the like.

The internal bag 110 can be made of various flexible, elastic and/or rigid materials, such as paper, plastic, fabric, textile, cardboard, metal, foil, wood, or the like. In various embodiments, the internal bag can be flexible and configured to fold for opening and closing. In various embodiments, the internal bag 110 can have an open top or can be configured to be closed such as with a drawstring, flap, friction fit, seal, weld or the like.

Also, while various embodiments can include an internal bag 110 that defines a cavity 112 (e.g., where gifts, confectionaries and the like can be held), further embodiments can include any suitable internal element, which may or may not be a bag (e.g., a box). In some embodiments, such an internal bag 110 element can be absent. For example, one or more articles can be enclosed within flaps 152 with an internal bag 110 being absent.

In various embodiments a method of constructing a gift bag 100 can comprise one or more of the following steps, which may or may not be in the following order. Such a manufacturing method can include nesting a second flap assembly 150B within a first flap assembly 150A and coupling the first and second flap assemblies 150A, 150B together at respective bases 154A, 154B (e.g., via glue, weld, adhesive, tape, or other suitable method). The method can further include coupling an internal bag 110 to the base 154B of the second flap assembly 150B. In some embodiments, the method can include generating hinges 730 in the flaps 152 of the first flap assembly 150A. In some embodiments, the method can include generating one or more holes 714 in the flaps 152 of the first flap assembly 150A above the hinges 730 and coupling one or more respective pulls 710 to the flaps 152 of the first flap assembly 150A. In some embodiments, the method can include coupling one or more couplers to the flaps 152 of the first flap assembly 150A above the hinges 730.

In various embodiments a method of loading a gift bag 100 can comprise one or more of the following steps, which may or may not be in the following order. Such a loading method can include disposing one or more gift articles in an internal bag 110. The method can include loading one or more butterflies 300 in a first left slot 180L, loading one or more butterflies 300 in a first right slot 180R, loading one or more butterflies 300 in a second left slot 185L and loading one or more butterflies 300 in a second right slot 185R. Such loading of a butterfly can include winding the butterfly 300 to store a rotation force in the butterfly 300 and generate a loaded configuration for the actuating butterfly 300, inserting the loaded butterfly 300 into a given slot (e.g., 180L, 180R, 185L, 185R), and closing the slot so that the loaded butterfly is held within the slot and to hold the loaded configuration of actuating butterfly 300. The method can further include securing tops of the flaps 152 of the first and second flap assemblies 150A, 150B together. For example, such securing can include securing a clip 130 over one or both of the tops of the flaps 152 of the first and second flap assemblies 150A, 150B; coupling together one or more couplers of one or both of the flaps 152 of the first and second flap assemblies 150A, 150B. As discussed herein, various items can be loaded into the internal bag 110 and various other suitable elements or items can be disposed within the slots 180, 185.

In various embodiments a method of opening a gift bag 100 can comprise one or more of the following steps, which may or may not be in the following order. Such a method in some examples can include a user removing a clip 130 from the top of the gift bag 100 to cause the flaps 152 to open outward and loaded butterflies 300 to be released from one or more slots (e.g., 180L, 180R, 185L, 185R). The method can further include the user removing gift items from the internal bag 110. Such a method in some examples can include a user pulling a pair of pulls 710 on opposing sides of the gift bag 100 to de-couple one or more couplers 720 at the top of the gift bag 100 to cause the flaps 152 to open outward and loaded butterflies 300 to be released from one or more slots (e.g., 180L, 180R, 185L, 185R).

The described embodiments are susceptible to various modifications and alternative forms, and specific examples thereof have been shown by way of example in the drawings and are herein described in detail. It should be understood, however, that the described embodiments are not to be limited to the particular forms or methods disclosed, but to the contrary, the present disclosure is to cover all modifications, equivalents, and alternatives. Additionally, elements of a given embodiment should not be construed to be applicable to only that example embodiment and therefore elements of one example embodiment can be applicable to other embodiments. Additionally, elements that are specifically shown in example embodiments should be construed to cover embodiments that comprise, consist essentially of, or consist of such elements, or such elements can be explicitly absent from further embodiments. Accordingly, the recitation of an element being present in one example should be construed to support some embodiments where such an element is explicitly absent.

What is claimed is:

1. A method comprising:

inserting a plurality of actuating surprise elements in a loaded state into a gift bag, the gift bag including:

a first flap assembly comprising:

a first and second flap movably coupled to and extending from a first base, a respective first and second hinge on the first and second flaps that allow the first and second flaps to bend and that define upper portions and lower portions of the first and second flaps, a first and second coupler defined by two pairs of corresponding coupler sides disposed respectively on internal faces of the upper portions of the first and second flaps of the first flap assembly, and a first and second pull respectively extending from opposing external faces of the upper portions of the first and second flaps of the first flap assembly, a second flap assembly, nested within the first flap assembly, the second flap assembly comprising a third and fourth flap movably coupled to and extending from a second base, the third and fourth flap having a shorter length than the first and second flaps, an internal bag nested within the first and second flap assemblies and that defines a bag cavity and opposing external faces, first and second slots defined by the external faces of the internal bag and the third and fourth flaps of the second flap assembly, and third and fourth slots defined by the first and second flaps of the first flap assembly and the third and fourth flaps of the second flap assembly, wherein inserting the plurality of actuating surprise elements in the loaded state into the gift bag includes inserting at least one loaded actuating surprise element into each of the first, second, third and fourth slots;

closing the first, second, third and fourth slots by folding the first, second, third and fourth flaps inward toward the internal bag such that the plurality of loaded actuating surprise elements are held in the loaded state based on respective contact with and being sandwiched between the external faces of the internal bag and the third and fourth flaps of the second flap assembly and respective contact and being sandwiched between the first and second flaps of the first flap assembly and the third and fourth flaps of the second flap assembly;

coupling the first and second couplers together to couple the first and second flaps of the first flap assembly together over a top of the second flap assembly and over a top of the internal bag, and to cause the plurality of actuating surprise elements to remain held in the loaded state based on the first and second couplers holding the first, second, third and fourth slots closed; and pulling on the first and second pulls extending from opposing external faces of the upper portions of the first and second flaps of the first flap assembly to:

cause the first and second couplers to de-couple;

cause the first, second, third and fourth flaps to open outward from the internal bag;

cause the first, second, third and fourth slots to open in response to the first, second, third and fourth flaps opening outward from the internal bag; and causing the plurality of loaded actuating surprise elements to fly out of the first, second, third and fourth slots and fly into the air in response to the first, second, third and fourth slots opening.

2. The method of claim 1, wherein the plurality of actuating surprise elements are actuating butterflies that each comprise:

a top portion and a bottom portion which are rotatably coupled via an axle that allows the top and bottom portions to rotate relative to each other about a central axis, and an actuating band that is coupled to the top portion via a first coupler and coupled to the bottom portion via a second coupler, the actuating band configured to allow the actuating butterfly to be loaded for actuation by rotating the top and bottom portions in opposite directions to introduce a twist into the actuating band, which stores a rotation force in the actuating band and generates the loaded state for the actuating surprise element.

3. The method of claim 1, wherein the first and second couplers comprise hook-and-loop tape.

4. The method of claim 1, wherein the first and second pulls comprise loops of ribbon that respectively extend through the upper portions of the first and second flaps.

5. The method of claim 1, wherein the first, second, third and fourth flaps are defined by respective planar rectangular flap members; and wherein the first and second bases are defined by respective planar rectangular base members.

6. A method comprising:

inserting a plurality of actuating elements in a loaded state into a gift bag, the gift bag including:

a first flap assembly comprising:

a first and second flap movably coupled to and extending from a first base, a first and second coupler defined by two pairs of corresponding coupler sides disposed respectively on internal faces of the first and second flaps of the first flap assembly, and a first and second pull respectively extending from opposing external faces of the first and second flaps of the first flap assembly, a second flap assembly, nested within the first flap assembly, the second flap assembly comprising a third and fourth flap movably coupled to and extending from a second base, an internal bag nested within the first and second flap assemblies and that defines a bag cavity and opposing external faces, first and second slots defined by the external faces of the internal bag and the third and fourth flaps of the second flap assembly, and third and fourth slots defined by the first and second flaps of the first flap assembly and the third and fourth flaps of the second flap assembly, wherein inserting the plurality of actuating elements in the loaded state into the gift bag includes inserting at least one loaded actuating element into each of the first, second, third and fourth slots;

closing the first, second, third and fourth slots by folding the first, second, third and fourth flaps inward toward the internal bag such that the plurality of loaded actuating elements are held in the loaded state based on respective contact with and being sandwiched between the external faces of the internal bag and the third and fourth flaps of the second flap assembly and respective contact and being sandwiched between the first and second flaps of the first flap assembly and the third and fourth flaps of the second flap assembly; and coupling the first and second couplers together to couple the first and second flaps of the first flap assembly together and to cause the plurality of actuating elements to remain held in the loaded state based on the first and second couplers holding the first, second, third and fourth slots closed.

7. The method of claim 6, further comprising:

pulling on the first and second pulls extending from the first and second flaps of the first flap assembly to:

cause the first and second couplers to de-couple, cause the first, second, third and fourth flaps to open outward from the internal bag;

cause the first, second, third and fourth slots to open in response to the first, second, third and fourth flaps opening outward from the internal bag; and causing the plurality of loaded actuating elements to fly out of the first, second, third and fourth slots and fly into the air in response to the first, second, third and fourth slots opening.

8. The method of claim 6, wherein the first flap assembly further comprises:

a respective first and second hinge on the first and second flaps that allow the first and second flaps to bend and that define upper and lower portions of the first and second flaps, and wherein the first and second pulls respectively extend from opposing external faces of the upper portions of the first and second flaps of the first flap assembly.

9. The method of claim 6, wherein the first and second couplers comprise hook-and-loop tape.

10. A method comprising:

inserting one or more actuating elements in a loaded state into a bag, the bag including:

a first flap assembly comprising:

a first and second flap movably coupled to and extending from a first base, at least one coupler comprising a pair of corresponding coupler sides disposed respectively at the first and second flaps of the first flap assembly, and a first and second pull respectively extending from the first and second flaps of the first flap assembly, a second flap assembly comprising a third and fourth flap movably coupled to and extending from a second base, an internal compartment disposed within the first and second flap assemblies and that defines a compartment cavity and opposing external faces, first and second slots defined by the external faces of the internal compartment and the third and fourth flaps of the second flap assembly, and third and fourth slots defined by the first and second flaps of the first flap assembly and the third and fourth flaps of the second flap assembly, wherein inserting the one or more actuating elements in the loaded state into the bag includes inserting at least one loaded actuating element into at least one of the first, second, third and fourth slots.

11. The method of claim 10, wherein the pair of corresponding coupler sides are disposed respectively on internal faces of the first and second flaps of the first flap assembly.

12. The method of claim 10, wherein the first and second pulls respectively extend from opposing external faces of the first and second flaps of the first flap assembly.

13. The method of claim 10, wherein the second flap assembly is nested within the first flap assembly.

14. The method of claim 10, wherein the third and fourth flap have a shorter length than the first and second flaps.

15. The method of claim 10, wherein the internal compartment is nested within the first and second flap assemblies.

16. The method of claim 10, wherein inserting the one or more actuating elements in the loaded state into the bag includes inserting at least one loaded actuating element into at least two of the first, second, third and fourth slots.

17. The method of claim 10, further comprising:

closing the first, second, third and fourth slots by folding the first, second, third and fourth flaps such that the one or more loaded actuating elements are held in the loaded state within one or more of the first, second, third and fourth slots.

18. The method of claim 10, further comprising:

coupling the at least one coupler together to couple the first and second flaps of the first flap assembly together and to cause the one or more loaded actuating elements to remain held in the loaded state based on the at least one coupler holding the first, second, third and fourth slots closed.

19. The method of claim 10, wherein the first flap assembly further comprises:

a respective first and second hinge on the first and second flaps that allow the first and second flaps to bend and that define upper and lower portions of the first and second flaps.

20. The method of claim 10, wherein the at least one coupler comprises hook-and-loop tape.

* * * * *